US009346597B2

(12) United States Patent
Bradfield

(10) Patent No.: US 9,346,597 B2
(45) Date of Patent: May 24, 2016

(54) BLISTER CARD WITH RETENTION FEATURE

(71) Applicant: MeadWestvaco Corporation, Richmond, VA (US)

(72) Inventor: Ryan C. Bradfield, Henrico, VA (US)

(73) Assignee: WestRock MWV, LLC, Norcross, GA (US)

( * ) Notice: Subject to any disclaimer, the term of this patent is extended or adjusted under 35 U.S.C. 154(b) by 0 days.

(21) Appl. No.: 14/368,949

(22) PCT Filed: Jan. 3, 2013

(86) PCT No.: PCT/US2013/020097

§ 371 (c)(1),
(2) Date: Jun. 26, 2014

(87) PCT Pub. No.: WO2013/103684

PCT Pub. Date: Jul. 11, 2013

(65) Prior Publication Data

US 2014/0353198 A1 Dec. 4, 2014

Related U.S. Application Data

(60) Provisional application No. 61/583,657, filed on Jan. 6, 2012.

(51) Int. Cl.
*B65D 73/00* (2006.01)

(52) U.S. Cl.
CPC ..... *B65D 73/0092* (2013.01); *B65D 73/0014* (2013.01); *B65D 2207/00* (2013.01)

(58) Field of Classification Search
CPC ..... B65D 73/0092; B65D 73/0014; B65D 85/42; B65D 73/0085; B24D 15/04; B24D 15/045; B24D 15/042
USPC ..... 206/470, 463, 462, 471, 461, 418, 484
See application file for complete search history.

(56) References Cited

U.S. PATENT DOCUMENTS

| | | | | |
|---|---|---|---|---|
| 3,203,542 | A * | 8/1965 | Lightner et al. | 206/463 |
| 3,407,928 | A * | 10/1968 | Watts, Jr. | 206/463 |
| 3,497,059 | A * | 2/1970 | Watts, Jr. | 206/463 |
| 5,379,886 | A * | 1/1995 | Brauner et al. | 206/216 |
| 5,429,229 | A * | 7/1995 | Chester et al. | 206/63.5 |
| 6,230,964 | B1 * | 5/2001 | Saito | 229/92.8 |
| 7,021,458 | B2 * | 4/2006 | Cummings | 206/77.1 |
| 7,621,405 | B2 * | 11/2009 | Schweitzer et al. | 206/703 |
| 7,726,480 | B2 * | 6/2010 | Nazari | 206/461 |
| 7,980,390 | B2 * | 7/2011 | Hession et al. | 206/462 |
| 2007/0187264 | A1 * | 8/2007 | Hofte et al. | 206/45.24 |
| 2007/0209957 | A1 * | 9/2007 | Glenn et al. | 206/462 |
| 2008/0283435 | A1 * | 11/2008 | Morgan | 206/484 |
| 2009/0038977 | A1 * | 2/2009 | Tilton | 206/469 |
| 2009/0272670 | A1 * | 11/2009 | Petrelli et al. | 206/736 |
| 2011/0240503 | A1 * | 10/2011 | Bailey | 206/469 |

FOREIGN PATENT DOCUMENTS

FR 2757489 A1 * 6/1998

* cited by examiner

*Primary Examiner* — Steven A. Reynolds
(74) *Attorney, Agent, or Firm* — WestRock Intellectual Property Group

(57) ABSTRACT

A package is disclosed which includes first panel (210) having a blister (150) attached thereto. A second panel (220) is hingedly attached to the first panel (210). The second panel (220) includes a cutout area (221) through which the blister body protrudes. A retention feature (155) on the blister body engages an edge of the cutout (221) to hold the second panel (220) in a position relative to the first panel (210).

19 Claims, 9 Drawing Sheets

BLISTER CARD WITH RETENTION FEATURE

REFERENCE TO RELATED APPLICATION

This application is a National Phase entry into the United States of PCT Application PCT/US13/20097 filed on Jan. 3, 2013 which claims the benefit of priority under 35 U.S.C. §119(e) of U.S. provisional application Ser. No. 61/583,657 filed on Jan. 6, 2012, both of which is prior applications are hereby incorporated by reference in their respective entireties.

BACKGROUND

This disclosure is directed to blister card packages and, more particularly, to blister packages with a crevice or groove feature in the blister which engages an edge of a card panel to hold the package shape in a desired configuration.

Manufacturers and retailers of consumer goods, such as pharmaceuticals, software, electronics, health and beauty products and the like, typically package their products in tamper resistant security packages. For example, many consumer goods are packaged in blister or clamshell packages formed by positioning a consumer good in a flanged blister made from various polymeric and/or paperboard materials and sealing the flanged blister between two paperboard substrates. Consumers have voiced disapproval of such packages because of the difficulty of opening the same and the potential for being cut on a rough edge especially of plastic blisters. Packages may therefore be made based largely on paperboard, for example, NATRALOCK packages. Packaging made primarily of paperboard is more sustainable than packaging made from petroleum-based plastics. The paperboard used in such packages may be tear-resistant as described in commonly assigned U.S. Pat. No. 7,144,635.

Some packages may comprise a paperboard card and a polymeric blister. Often the paperboard card may be a planar or flat construction. Such a construction may not stand up readily, or may lack visual interest. It would be advantageous to have a package that provides a feature to help the package stand upright, or form a more interesting, non-planar structure.

SUMMARY

In one aspect a package is disclosed which includes a blister attached to a card. The card may have at least a first and second panel. The blister may be more firmly attached to the first panel and less firmly attached to the second panel. An edge or an opening in the second panel may removably and reversibly engage a feature of the blister to hold the second panel in a particular configuration or orientation relative to the first panel. The engagement between the blister and second card may be non-destructive to both blister and second card.

In certain aspects, the engagement between the blister and the second panel may hold the package in a configuration where the second panel is in a different plane than the first panel.

In certain aspects, the engagement between the blister and the second panel may hold the package in a configuration that allows the package to stand upright on an edge of both the first and the second panel.

Other aspects of the disclosed package will become apparent from the following description and the accompanying drawings.

DETAILED DESCRIPTION

Figure 1:
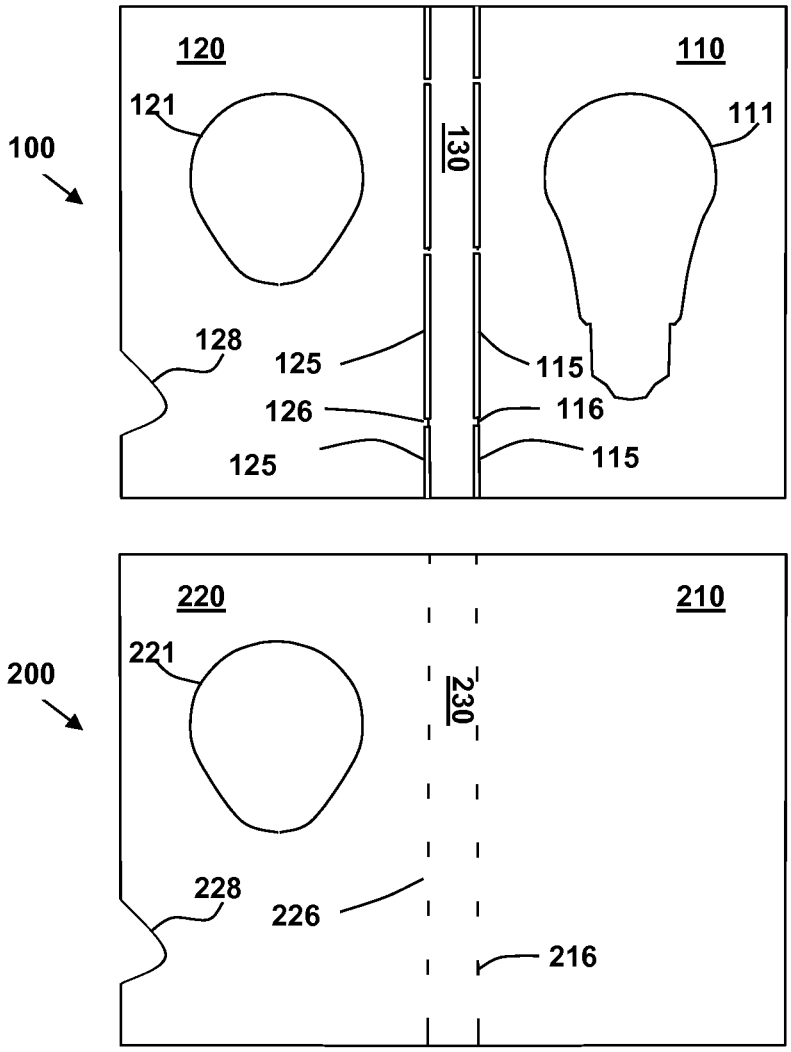
FIG. 1 is a front plan view of blanks to form a blister package.

As various embodiments of the package are described, reference will be made to FIGS. 1-9. Certain parts of the packages are denoted by reference numerals. Where there is more than one of the same feature, generally only one will be denoted by a reference numeral. Typically in these Figures, where a front plan view is shown for a blank of material, solid lines usually indicate periphery or cuts, and dashed lines usually indicate crease, score, or fold lines. In perspective views, solid lines typically show edges or folds, while dashed lines typically show hidden or partially obscured features. Where assembly steps are described, these steps are exemplary and are not to be limiting as to the sequence of operations used to arrive at the final package. Also, directions such as up, down, top, bottom, front, back, etc. are used for convenience in describing the package and are not meant to be limiting. The packages described here may be made from one blank (that is, the cut sheet parts from which the package components are made by folding and other steps) or from more than one blank. The word "card" or "panel" will often be used to describe a piece of sheet material such as paperboard, particularly with respect to a blank from which the package is made. Since panels are sometimes superimposed, for example, creating a two-layer or multi-layer structure, like features or panels will sometime coincide, in which cases, descriptions may call out the number identifying the feature closer to the viewer, that is, the feature visible in a particular Figure.

FIG. 1 shows a front plan view of a first blank 100 which and second blank 200 for forming a package. The first blank 100 as illustrated in the example here will become the "interior" of the package, while the second blank 200 will become the "exterior" of the package. First blank 100 may include left panel 120 and right panel 110, with optional spine panel 130 therebetween. Relief cuts 125 and 115 may be provided along hinge lines between the left panel and spine, and the spine and right panel, respectively. The relief cuts are optional and may allow easier assembly of the package. Connecting portions 126 and 116 may be provided between the relief cuts.

A first or 'partial' cutout 121 may be provided in the right panel 120 and a second or 'full' cutout 111 may be included in the left panel 110, These cutouts may receive a blister 150 as described below.

Second blank 200 may include left panel 220 and right panel 210, with optional spine panel 230 therebetween. Fold or crease lines 226, 216 may be provided along hinge lines between the left panel and spine, and the spine and right panel, respectively. A 'partial' cutout 221 may be provided in the left panel 220. This cutout may receive a blister 150 as described below.

One or more notches 128, 228 may be provided in one or both panels (here in left panel 120). Such notches may be used to facilitate handling of the package, or for aesthetic reasons.

Figure 2:
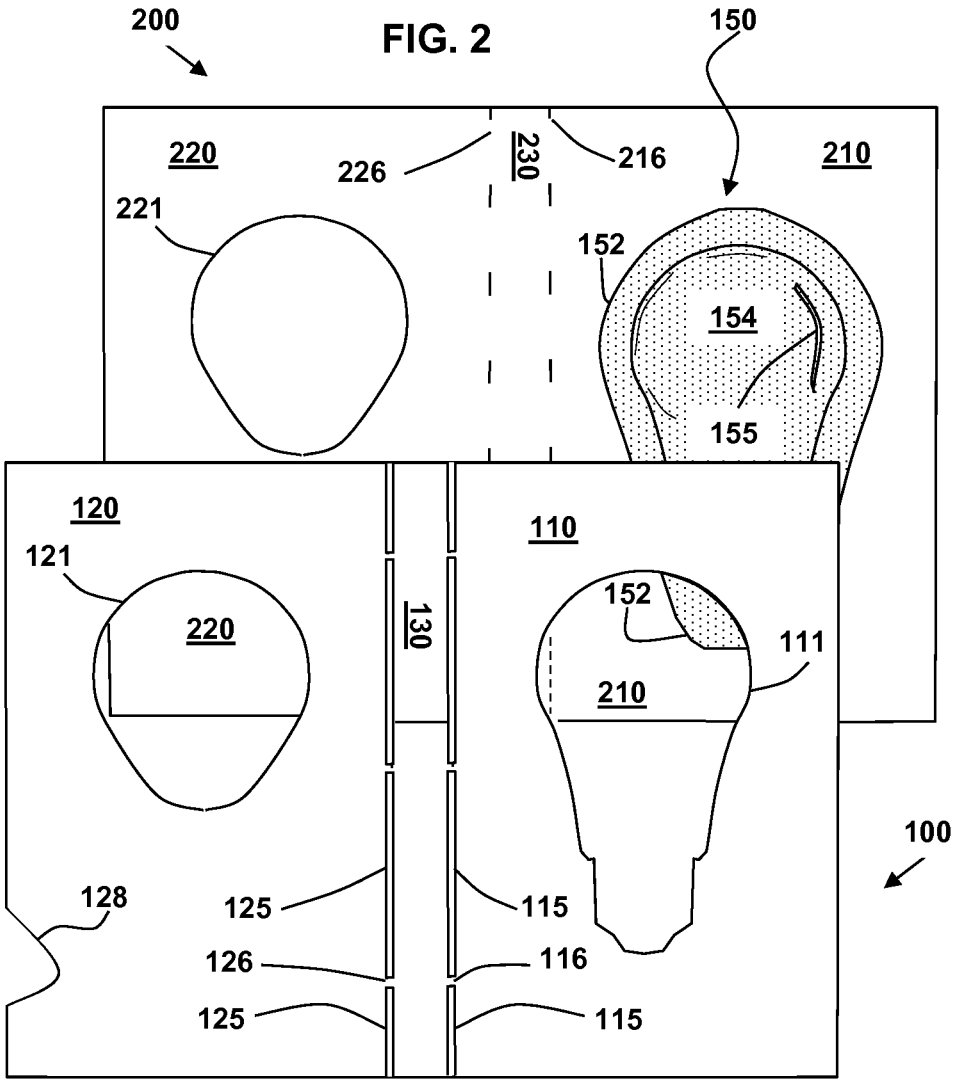
FIG. 2 is a front plan view of the blanks aligned to assemble the package.

As a step in the assembly of the package, FIG. 2 shows first blank 100 situated in front of second blank 200, with a blister 150 placed between the blanks and aligned with 'full' cutout 111. Blister 150 may have a peripheral flange 152 extending at least partly around the blister. The flange 152 may therefore be sandwiched between right panels 110, 210, while the blister body 154 protrudes through cutout 111.

Figure 3:
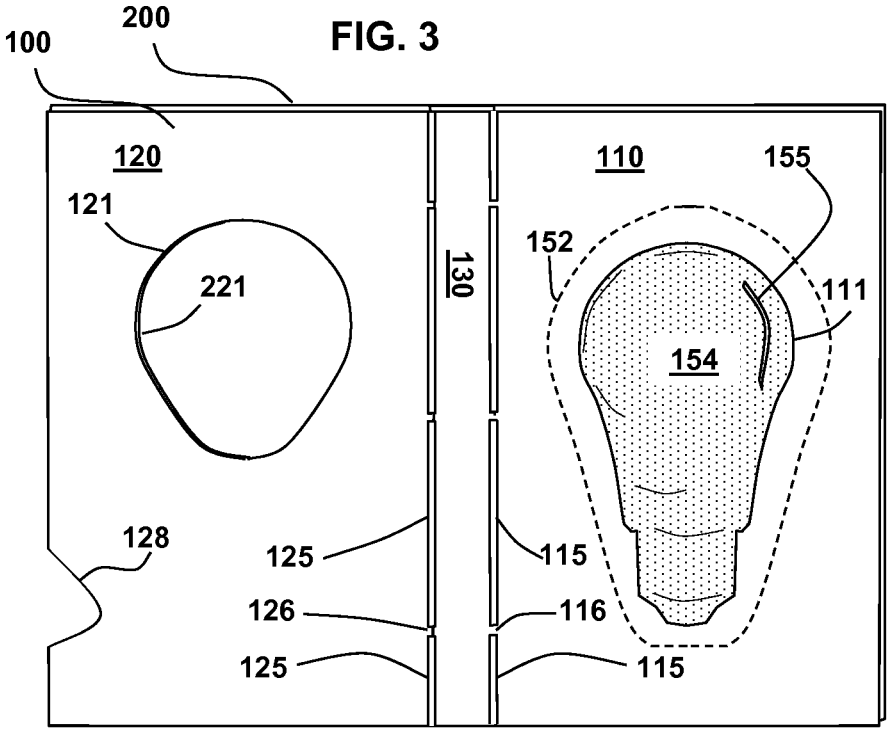
FIG. 3 is a front plan view of the assembled package in a flat configuration.

FIG. 3 shows the assembled package with the first blank 100 overlaid on the second blank 200 to form a two-ply structure with the blister flange 152 sandwiched between the right panels 110, 210 and the blister body 154 protruding through the full cutout 111. On the left panels 120, 220 the partial cutouts 121, 221 may be aligned to form an opening through the left panels. The blanks may be formed with a heat seal layer on their facing sides. The blanks may be heat sealed or otherwise attached to one another. One or both blanks may be made of a tear-resistant material.

Blister body 154 may have a retention feature 155 to engage an edge of the partial cutouts 121, 221. Retention feature 155 may take the form of a groove, depression, slot, cutout, slit, ridge, bump, protrusion, or other feature or shape suitable for engaging the partial cutout 121, 221.

Figure 4:
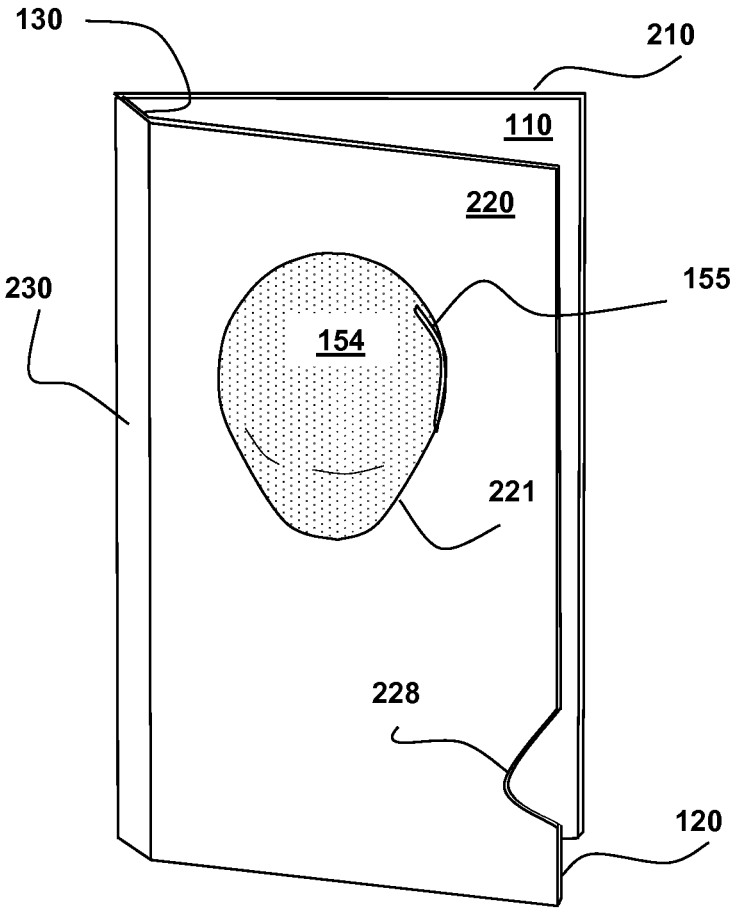
FIG. 4 is a front perspective view of the assembled package in a folded configuration.

FIG. 4 shows the package after the left panels 120, 220 have been folded over toward the right panels 110, 220. A portion of the blister body 154 protrudes through partial cutout 221, and an edge of cutout 221 engages the retention feature 155 to hold the panels relative to one another. In the example as shown, the retention feature 155 is situated to engage a 'far' edge of the cutout 221 relative to the spine 230. However, a retention feature may also be provided to engage the cutout along a 'near' edge relative to the spine, or along a 'top' or 'bottom' edge or other edge of the cutout 221.

Figure 5:
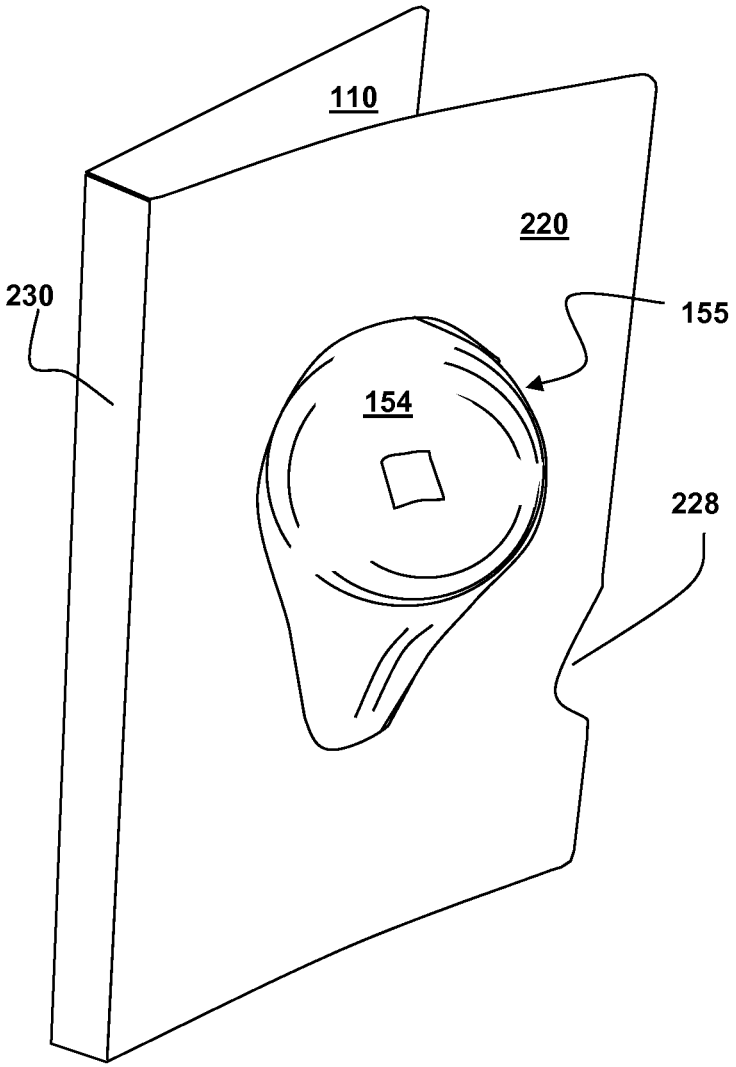
FIG. 5 is another front perspective view of the assembled package.

FIG. 5 shows another view of the package.

Figure 6:
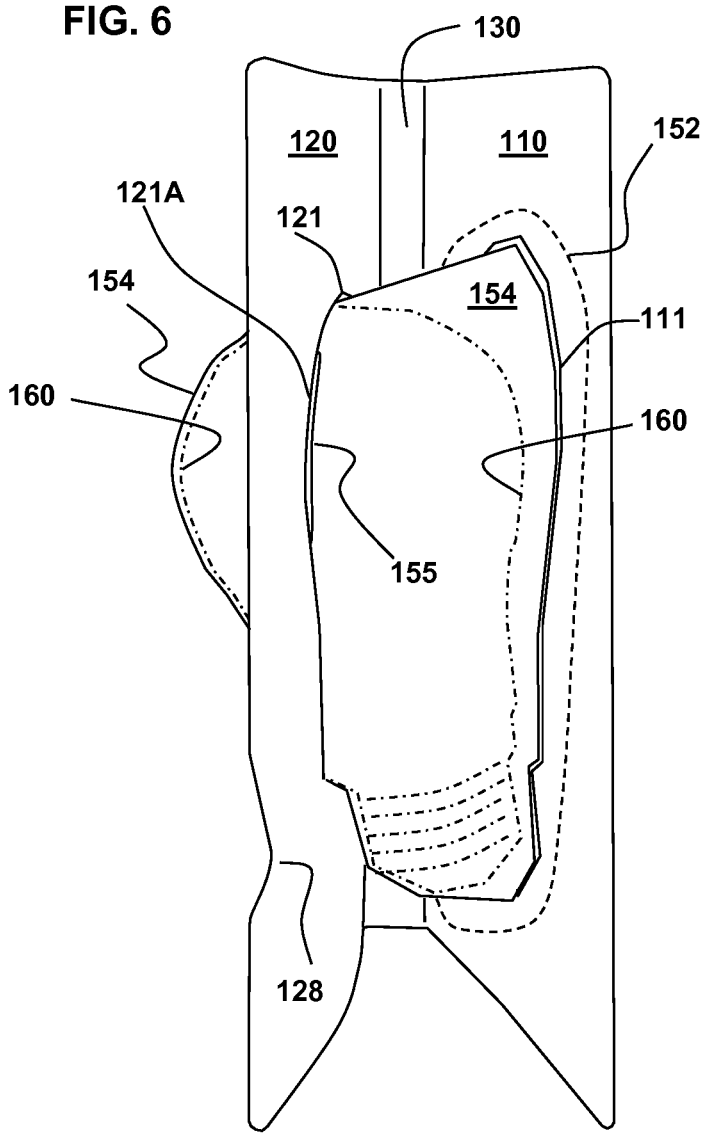
FIG. 6 is a side perspective view of the assembled package.

FIG. 6 shows a side perspective view of the package from the 'open' side. The 'inside' of the package is visible including left panel 120, right panel 110, and spine panel 130. The blister flange 152 is sandwiched between panels 110, 210 while blister body 154 extends through full cutout 111 in panel 110. An article 160 (in this case, a light bulb) is shown inside blister body 154. The blister body may be shaped to fit the article 160. The blister body 154 also extends partly through partial cutout 121 in panel 120. An edge 121A of cutout 121 engages a retention feature 155 in the blister body. The retention feature holds panel 120 in position relative to panel 110. The retention feature 155 may take the form of a groove, depression, slot, cutout, slit, ridge, bump, protrusion, or other feature or shape suitable for engaging the partial cutout 121.

Figure 7A:
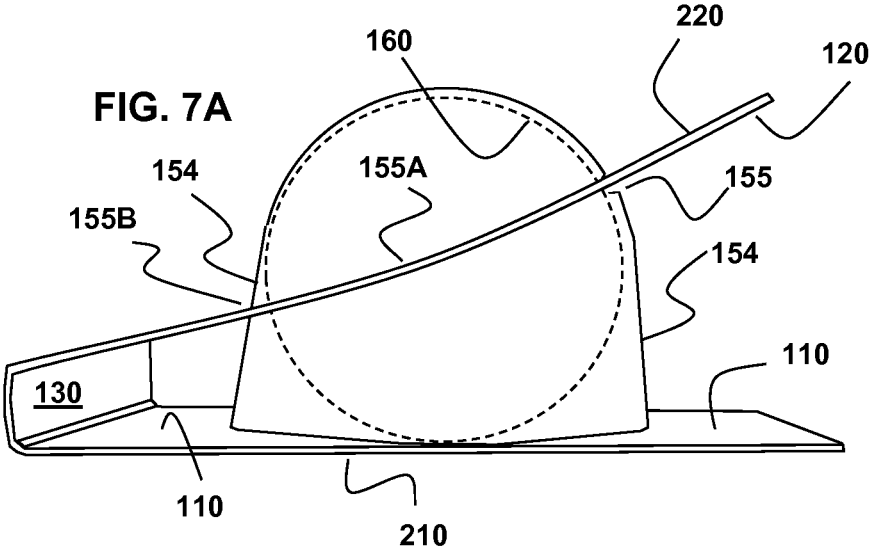
FIGS. 7A and 7B are top and bottom perspective view of the assembled package.
Figure 7B:
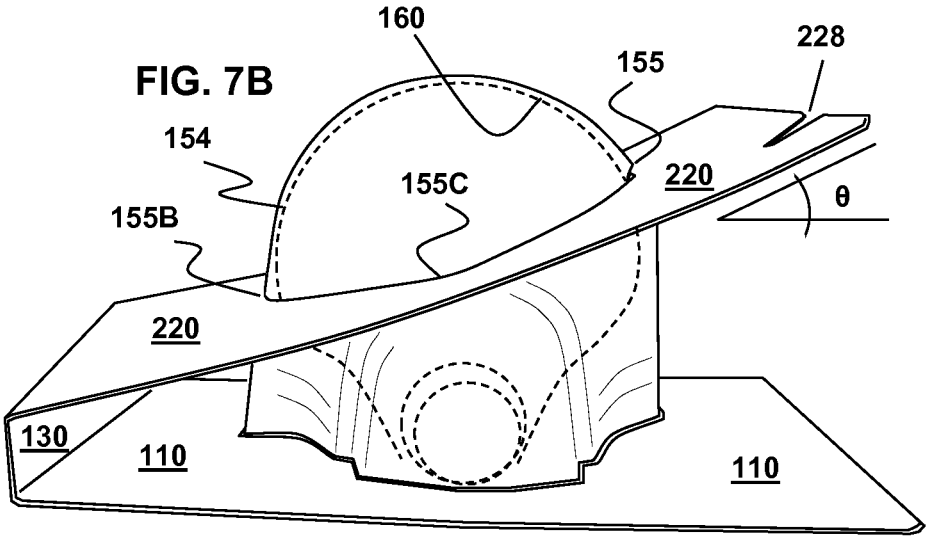

FIGS. 7A and 7B show top and bottom perspective views of the package. Certain 'inside' panels of the package are partly visible including right panel 110 and spine panel 130 as are certain 'outside' panels of the package including left panel 220. The blister body 154 contains an article 160 which in this example is a light bulb. The blister body 154 extends away from panels 110, 210 and partly through the partial cutout in panels 120, 220. An edge of the cutout engages retention feature 155 in the blister body. The retention feature holds panels 120, 220 in position relative to panels 110, 210. The retention feature 155 may be located on an area of the blister body 154 away from the spine 130. However the retention feature may also be located at other locations on the blister body such as at point 155A toward the top of the blister body, or point 155B nearer to spine 130, or point 155C (FIG. 7B) toward the bottom of the blister body. The retention feature 155 may take the form of a groove, depression, slot, cutout, slit, ridge, bump, protrusion, or other feature or shape suitable for engaging the partial cutout 121. More than one type of retention feature 155 may be utilized, at more than one location on the blister body 154. The retention feature or features may hold the package panels at a particular angle θ relative to one another. For example the angle θ may be between 15 and 60 degrees. However, the angle may be less than 15 or more than 60 degrees. The retention feature or features may be positioned to allow the partial cutout to engage the blister so as to hold the panel 120, 220 in more than one position relative to the panel 110, 210, for example at more than one value of angle θ.

A small amount of flexing stress may be present in the panel 120, 220 when the retention feature 155 is engaged. This may curve the panel 120, 220 slightly as shown in FIGS. 7A-7B. This curve may add interest to the package, and it may be possible to adjust the placement of location of retention feature 155, the height of the spine 130, 230 (if a spine is used) and the size of the partial cutout to increase or decrease the amount of the curve.

The size of the spine panel 130, 230 may be chosen to suit the size of the blister body 154, or the spine panel may be omitted. For example a large blister may in some cases benefit from a larger spine. However, even with a large blister the spine may be optional.

Figure 8A:
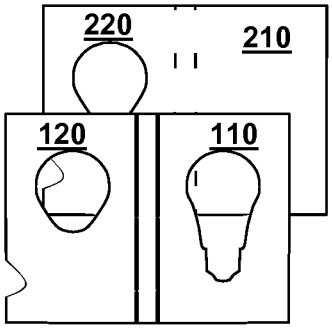
FIGS. 8 and 9 are front plan views of various paperboard blanks for making the package.

The example thus far has described a package including a right panel 110, 210, spine panel 130, 230, and left panel 120, 220, the package being formed in two plies from two separate blanks 100, 200 joined together with the blister flange 152 sandwiched between right panels 110, 210. FIG. 8A shows the blanks used for forming this package (also previously shown in FIG. 1).

Figure 8C:
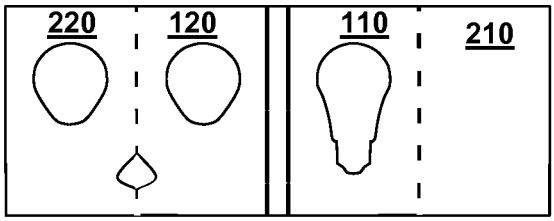
Figure 8B:
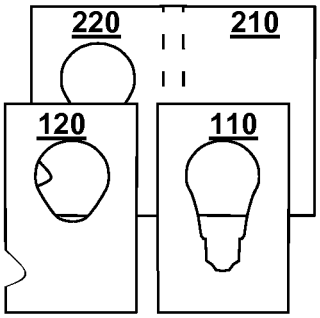

FIG. 8B shows an alternative set of three blanks including the same ('outer' ply) of right and left panels 210, 220 joined together by a spine. However 'inner' ply panels 110 and 120 may be provided as shown each by a separate blank.

FIG. 8C shows an alternative single blank in which panels 220, 120 are joined though a spine to panels 110, 210. The blister 150 may be inserted from behind panel 110, and panel 210 folded backward to trap the blister flange 152 and form the right portion of the package. Panel 220 may then be folded either forward or backward upon panel 120 to form the left portion of the package.

Figure 8D:
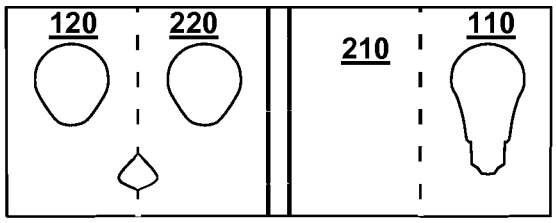

FIG. 8D shows an alternative single blank somewhat similar to FIG. 8C, in which panels 220, 120 are joined though a spine to panels 110, 210. The blister 150 may be inserted from in front of panel 110, and panel 110 folded forward over panel 210 to trap the blister flange 152 and form the right portion of the package. Panel 120 may then be folded either forward or backward upon panel 220 to form the left portion of the package.

Figure 9A:
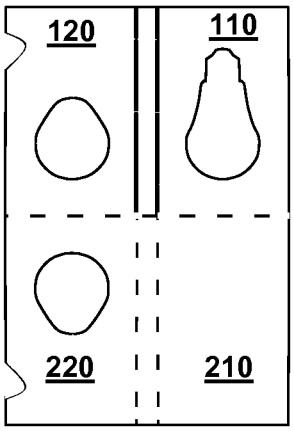

FIG. 9A shows an alternative single blank in which panels 220, 120 are joined across their top edge to panels 110, 210. The blister 150 may be inserted from in front of panel 110, and panels 110, 120 folded forward over panels 210, 220 to trap the blister flange 152 and form the two plies of the package.

Figure 9B:
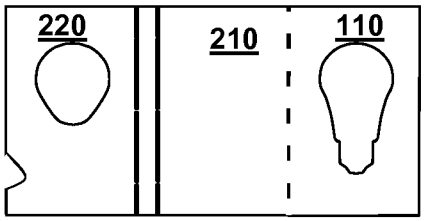

FIG. 9B shows an alternative single blank, somewhat similar to FIG. 8D. Panel 220 is joined though a spine to panels 110, 210. The blister 150 may be inserted from in front of panel 110, and panel 110 folded forward over panel 210 to trap the blister flange 152 and form the right portion of the package. Panel 220 forms a single ply left portion of the package.

The spine panels 130, 230 are optional. For example, FIG. 9C is similar to FIG. 9B, but lacks a spine panel.

Figure 9C:
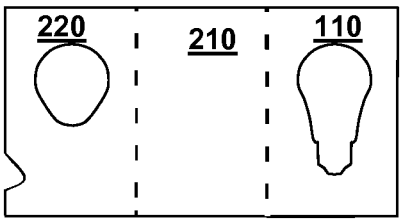
Figure 9D:
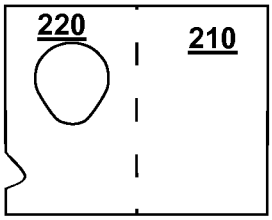

As shown in FIGS. 9B and 9C, the left panel (220) may be a single ply of material. As shown in FIG. 9D, the right panel (210) may likewise be a single ply of material. In this case the blister flange 152 is not sandwiched between panels 110, 210 but may be otherwise attached to panel 210, for example by adhesive, staples, or other means.

It will be understood that the illustrated constructions are examples and do not necessarily include all possible constructions. In any of the constructions, a blister may be attached to one panel (e.g. the right panel or panels). The blister may include a retention feature to engage a cutout on another panel (e.g. the left panel or panels). It will be understood also that in some constructions the spine panel(s) are optional. In some constructions the second ply of material on the spine panel, left panel, or right panel are optional.

Although the blister constructions shown here generally are for a blister that completely encloses a product, it is also contemplated that portions of the blisters may be left open, for example to allow a customer to handle the product such as feeling the texture, observing the product directly (without looking through the blister material), testing a fit (e.g. for an electrical connection), and for other purposes.

The packages as described herein may be closed and sealed once the contents are placed inside the blister. Once filled, the blister 150 may be placed into the full cutout 111 in panel 110 and the flange 152 sandwiched between two layers of material. The layers (and flange) may then be joined together by heat sealing, adhesive, staples, or other suitable method.

The first blank 100 and second blank 200 (or depending on design, a single blank or additional blanks) may be formed of a sheet material such as paperboard, which may be made of or coated with materials to increase its strength. An example of such a sheet material is EASYSEAL paperboard made by MeadWestvaco Corporation. The sheet material may have a heat sealable coating, for example to allow a heat seal to be created between the first blank 100 and second blank 200. Alternately, other forms of adhesive may be used to seal these parts together. It should be noted that the use of tear resistant materials, and/or in more than one layer, help to improve the tamper- and theft-resistance of the package. The panels may be joined together by heat sealing, RF (radio frequency) sealing, ultrasonic sealing, adhesive, or other means. Such sealing may be done on most of the facing surfaces of the front and back panels or sealing may be done to less than the entire facing surfaces, for example only around the outer perimeter of the package, and along or upon part or all of flange 152.

Blister 150 may be made with common thermoform plastics such as PVC or APET but may also include a recycled material such as RPET or a biodegradable material such as PLA. However other materials including other plastics or paperboard may also be used. Besides thermoforming, the case or blister may be formed by injection molding or other manufacturing methods. The blister may be formed in one or more pieces. One or more blisters may be used in the package.

It should be understood that additional panels or fold-over panels may be included in the package for further reinforcing the package, providing additional advertising space, and so on.

The invention claimed is:

1. A packaging structure comprising:

a first panel comprised of sheet material and having a hinge edge and a free edge opposite from the hinge edge, the free edge not directly attached to any other panel;

a second panel comprised of sheet material and having a first edge hingedly attached directly or indirectly to the first panel hinge edge, the second panel comprising a first cutout and a second edge opposite the first edge and not directly attached to the first panel or any other panel;

a blister attached to the first panel, the blister having a body and a peripheral flange, the body having a retention feature spaced apart from the flange and from the first panel;

wherein, when the second panel is folded relative to the first panel, at least a portion of the body protrudes through the first cutout and an edge of the first cutout engages the retention feature, thereby holding the second panel in position relative to the first panel and at an angle between 15 and 60 degrees relative to the first panel.

2. The package of claim 1, wherein the retention feature is a groove or slot in the body.

3. The package of claim 1, further comprising a spine panel positioned between the first and second panels and through which the first edge is hingedly attached indirectly to the first panel, the spine panel not being parallel to either the first or second panels.

4. The package of claim 1, wherein the first panel comprises two plies of material and the peripheral flange is located between the two plies.

5. The package of claim 1, wherein the first panel comprises two plies of material and the blister body protrudes through a second cutout in one of the two plies.

6. The package of claim 1, wherein the second panel is curved when the retention feature is engaged with the first cutout.

7. The package of claim 1, further comprising at least one additional panel hingedly connected to the first or second panel.

8. The package of claim 1, wherein the sheet material is paperboard.

9. A method of using a packaging structure, the method comprising:

providing a first panel comprised of sheet material and having a hinge edge and a free edge opposite from the hinge edge, the free edge not directly attached to any other panel;

providing a second panel comprised of sheet material and having a first edge hingedly attached directly or indirectly to the first panel hinge edge, the second panel comprising a first cutout and a second edge opposite the first edge and not directly attached to the first panel or any other panel;

providing a blister having a body and a peripheral flange, the body having a retention feature spaced apart from the flange;

attaching the blister to the first panel, folding the second panel relative to the first panel along the first edge, so that at least a portion of the body protrudes through the first cutout, and engaging an edge of the first cutout with the retention feature, thereby holding the second panel at an angle between 15 and 60 degrees relative to the first panel with the retention feature spaced apart from the first panel.

10. The method of claim 9, wherein the retention feature is a groove or slot in the body.

11. The method of claim 9, further comprising providing a spine panel positioned between the first and second panels through which the first edge is attached to the first panel, the spine panel not being parallel to either the first or second panels.

12. The method of claim 9, wherein the first panel comprises two plies of material and the peripheral flange is located between the two plies.

13. The method of claim 9, wherein the first panel comprises two plies of material and the blister body protrudes through a second cutout in one of the two plies.

14. The method of claim 9, wherein the second panel is curved when the retention feature is engaged with the first cutout.

15. The method of claim 9, further comprising providing at least one additional panel hingedly connected to the first or second panel.

16. The method of claim 9, wherein the sheet material is paperboard.

17. The method of claim 9, further comprising providing a product item within the blister body.

18. The package of claim 1, wherein the second panel is not in facing contact with the first panel.

19. The method of claim 9, wherein the second panel is not in facing contact with the first panel.

* * * * *